US006315081B1

(12) United States Patent
Yeo

(10) Patent No.: US 6,315,081 B1
(45) Date of Patent: Nov. 13, 2001

(54) APPARATUS AND METHOD FOR CONTROLLING OPERATION OF ELEVATOR IN POWER FAILURE

(75) Inventor: Hwan Je Yeo, Changwon (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/461,768

(22) Filed: Dec. 15, 1999

(30) Foreign Application Priority Data

Dec. 15, 1998 (KR) ..... 98-55140

(51) Int. Cl.[7] ..... B66B 1/06
(52) U.S. Cl. ..... 187/290; 187/293
(58) Field of Search ..... 187/290, 293, 187/295, 296; 318/779, 781, 782, 799–815; 307/64, 66

(56) References Cited

U.S. PATENT DOCUMENTS 4,399,892 * 8/1983 Watanabe ..... 187/29 R
4,484,664 * 11/1984 Nomura ..... 187/29 R
4,548,299 * 10/1985 Nomura ..... 187/29 R
5,285,029 * 2/1994 Araki ..... 187/114
5,894,910 * 4/1999 Suur-Askola et al. ..... 187/290
5,896,948 * 4/1999 Suur-Askola et al. ..... 187/290
5,945,644 * 8/1999 Jang ..... 187/296
5,969,303 * 10/1999 Piserchia et al. ..... 187/297

FOREIGN PATENT DOCUMENTS 53-34245-A * 3/1978 (JP) .
08-169658 2/1996 (JP) .
09-002753 7/1997 (JP) .
5-208787-A * 8/1993 (JP) ..... 187/290

* cited by examiner

*Primary Examiner*—Jonathan Salata

(57) ABSTRACT

An apparatus for controlling an operation of an elevator includes a power supply unit for detecting whether the main power supply was supplied including a charger and for outputting a predetermined control signal, an operation control unit for receiving the control signal from the direct current power supply unit and a demand control signal inputted by a user and for outputting a speed control signal and a load compensation signal so as to control the elevator system, a power consumption detector for computing a power consumption of the alternating current motor, a speed limiter for limiting a speed of the motor upon receipt of the alternating current motor speed signal from the speed detector and the power consumption of the motor computed by the power consumption detector, and a speed control unit for controlling a rotational speed of the alternating current motor upon receipt of the load compensation signal and the control signal from the speed limiter. By having such construction, the discharge amount of a charged power supply is minimized when an elevator is operated on the charged power supply in an emergency and an over current is prevented.

8 Claims, 8 Drawing Sheets

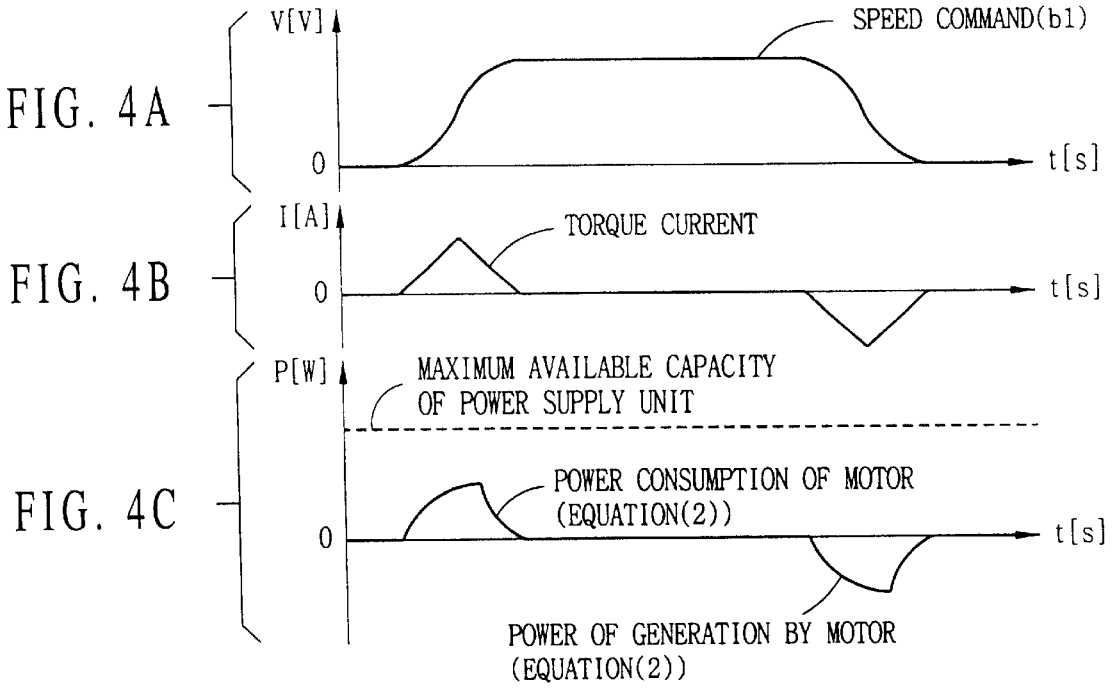
FIG. 4A
V[V]
SPEED COMMAND(b1)
0
t[s]
FIG. 4B
I[A]
TORQUE CURRENT
0
t[s]
FIG. 4C
P[W]
MAXIMUM AVAILABLE CAPACITY
OF POWER SUPPLY UNIT
POWER CONSUMPTION OF MOTOR
(EQUATION(2))
0
t[s]
POWER OF GENERATION BY MOTOR
(EQUATION(2))
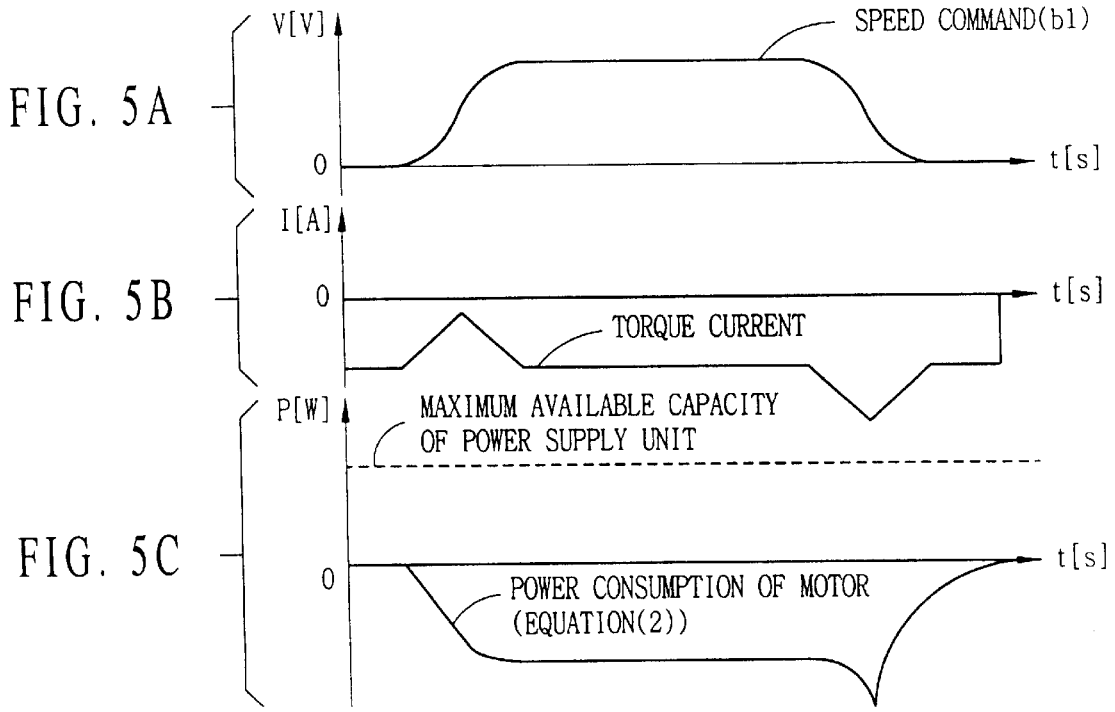
FIG. 5A
V[V]
SPEED COMMAND(b1)
0
t[s]
FIG. 5B
I[A]
0
t[s]
TORQUE CURRENT
FIG. 5C
P[W]
MAXIMUM AVAILABLE CAPACITY
OF POWER SUPPLY UNIT
0
t[s]
POWER CONSUMPTION OF MOTOR
(EQUATION(2))

V[V]
0
t[s]
SPEED COMMAND(b1)

I[A]
0
t[s]
TORQUE CURRENT

P[W]
POWER CONSUMPTION OF MOTOR
(EQUATION(2))
0
t[s]
MAXIMUM AVAILABLE CAPACITY
OF POWER SUPPLY UNIT
OVER CURRENT OF POWER SUPPLY UNIT
AND POSSIBILITY OF EARLY DISCHARGING OF BATTERY

V[V]
0
t[s]
SPEED COMMAND OF SPEED LIMITER(b1)
SPEED LIMIT VALUE(VL)
SPEED COMMAND OF OPERATION CONTROL UNIT

I[A]
0
t[s]
TORQUE CURRENT OF MOTOR

P[W]
0
t[s]
MAXIMUM AVAILABLE CAPACITY OF POWER SUPPLY UNIT
POWER FOR OPERATING SPEED LIMITER
POWER CONSUMPTION OF MOTOR WHEN SPEED IS LIMITED
TIME POINT OF OPERATION OF SPEED LIMITER

APPARATUS AND METHOD FOR CONTROLLING OPERATION OF ELEVATOR IN POWER FAILURE

BACKGROUND OF THE INVENTION

1. Field of the Invention

The present invention relates to a technique of operating an elevator in emergency by using a charged power supply in case that a power supply from a commercial main power source is shut down in an elevator system, and more particularly, to an apparatus for controlling an operation of an elevator in a power failure which is capable of minimizing discharge amount of a charged power supply when an elevator is operated on the charged power supply in emergency and of preventing an over current from flowing, and to its method.

2. Description of the Background Art

In case that an elevator car is unexpectedly stopped between floors during its operation due to a power failure, the car is supposed to perform an emergency operation toward nearest floor so as to have passengers get off therefrom.

In preparation for such a power failure, in order to supply a power to the elevator system, a power supply unit is additionally provided to a control board, and the power supply unit typically has a charger and a charging battery where tens of volt of direct current power supply is normally charged.

That is, when a power failure state that a main power is not supplied is detected by the power supply unit, a direct current power supply charged in the charging battery is converted to an alternate current power supply, which is then converted to an alternate current power supply having the same frequency as that of the main power supply via a step-up transformer and an inverter, and is supplied to an input terminal of a rectifier, according to which the elevator system is operated in emergency.

FIG. 1 is a schematic block diagram of an apparatus for controlling an operation of an elevator in a power failure in accordance with a conventional art.

As illustrated in the drawing, the apparatus for controlling an operation of an elevator in a power failure in accordance with a conventional art includes a main power supply inputting contactor 2 for supplying a main power supply 1 in normal state by being closed or for blocking a power input path from the main power supply 1 in power failure by being opened, a rectifier 3 and a smoothing condensor 4 for converting alternate current input from an main power source to a direct current and smoothing it, a discharging transistor 5 and a resistor 6 for limiting a charged voltage of the condensor 4 from rising to more than a predetermined level, an inverter 7 for inverting a direct current voltage outputted from the smoothing condensor 4 according to an output signal from a pulse width modulation signal generator 20 (to be described later) to an AC voltage, current detectors 8A, 8B and 8C for detecting a current supplied from the inverter 7 to an AC motor 9, the AC motor 9 driven by an output power supply of the inverter 7, a rotary encoder 10 for detecting a rotational speed of the motor 9 and outputting a pulse, a sheave 11 for receiving a driving force from a driving shaft of the alternate current motor 9 and winding or releasing an elevator car 13 in a vertical direction, a balance weight 12 connected to the elevator car 13, having a predetermined weight so as for the car to be balanced, and vertically operated in the opposite direction to the elevator car 13, a hall call button unit 14 for being pushed by passengers waiting on the hall of each floor and calling the elevator car 13, a car call button unit 15 for passengers in the elevator car 13 to select destination floors, a load detector 16 for detecting a load amount of the elevator car 13 a power supply unit 17 with a charger for emergency operation of the elevator in case of a power failure, an operation control unit 18 for controlling an operation of the elevator system according to a hall call from the hall call button unit 14 or car call from the car call button unit 15, a speed control unit 19 for outputting a speed control signal upon receipt of a speed command from the operation control unit 18, and a pulse width modulation signal generator 20 for outputting a pulse width modulating signal upon receipt of the speed control signal.

The operation of the apparatus for controlling an operation of an elevator in accordance with the conventional art constructed as described above will now be explained.

In a normal operation that the main power 1 is normally supplied to the elevator system, the operation control unit 18 generates a speed command b1 to operate the elevator according to a call from the hall call button unit 14 and the car call button unit 15, computes a weight difference between the balance weight 12 and the elevator car 13 on the basis of the load amount of the elevator car 13 detected by the load detector 16, and accordingly outputs a load compensation signal b2.

When the speed control unit 19 outputs a predetermined speed control signal to the pulse width modulation (PWM) signal generator 20 according to the speed command b1 outputted from the operation control unit 18, the pulse width modulating signal generator 20 controls the width of the pulse signal and outputs it to the inverter 7. Then, the inverter 7 accordingly controls a rotation speed of the alternate current motor 9.

The operation of the power supply unit 17 will now be described with reference to FIG. 2.

A main power supply failure detecting unit 17A monitors whether the main power supply 1 is supplied to the elevator system. When the main power is normally supplied to the elevator system, a battery voltage detecting unit 17G checks a voltage of the charging battery 17F, and if the voltage is lowered down to below a pre-set voltage level, the battery voltage detecting unit 17G drives a battery charging control unit 17I.

Accordingly, a predetermined pulse width modulating signal is outputted from the pulse width modulation signal generator 17K, and accordingly a voltage from the main power supply 1 is sequentially charged through a transformer 17C and a power converting unit 17D.

In case that the power failure detecting unit 17A detects a power failure state that the main power is not supplied to the elevator system, the main power input contactor 2 is turned off by a turn-off signal from a contactor drive unit 17B.

At this time, the AC power supply control unit 17J is operated so that the DC power charged in the battery 17F is converted to an AC power through the inverter 17D. Thus, the DC voltage from the battery 17F is inverted to an AC voltage having the same frequency as the voltage of the main power via inverter 17D, coils L1,L2,L3 and the transformer 17C and is outputted to the rectifier 3.

As the power failure detecting unit 17A detects the power failure and outputs a power failure detecting signal al to the operation control unit 18, the operation control unit 18 switches a normal operation mode to a power failure operation mode to perform an emergency operation. And, when the emergency operation is completed, the operation control unit 18 outputs an operation completion signal to the power supply unit 17, and accordingly, the operation of the power supply unit 17 is stopped.

Meanwhile, when the power supply unit 17 detects the power-failure and outputs a signal that the main power is not supplied to the elevator system to the operation control unit 18, the operation control unit 18 computes a weight difference between the balance weight 12 and the elevator car 13 on the basis of the load detect signal of the load detector 16.

In case that a weight of the balance weight 12 is heavier than that of the car 13, the operation control unit 18 determines that the running direction of the elevator car 13 is to be an upward direction, and in the opposite case, it determines that the operation direction of the elevator car 13 is to be a downward direction, and then outputs a speed command b1 to control the speed of the motor 9.

When the car 13 is started to be operated after its running direction is determined, the motor 9 is operated by an electricity generator, of which a generated energy is consumed as a heat by the discharging transistor and the resistor 6.

FIG. 3 is a detailed block diagram of the speed control unit of FIG. 1 in accordance with the conventional art.

Referring to FIG. 3, the process that the speed control unit 19 performs a speed control function according to the speed command b1 outputted from the operation control unit 18 will now be described.

When a current detector 19A detects a current detect signal corresponding to the current amount of each phase detected through each of the current detecting elements 8A~8C and outputs it to a current converter 19B, the current converter 19B converts it to a current of torque component and a current of magnetic flux component and outputs it.

A speed detector 19C detects a rotation speed of the alternate current motor 9 on the basis of a pulse signal outputted from the rotary encoder 10, and outputs a speed detect signal corresponding to the rotation speed.

A magnetic flux command generator 19D generates a magnetic flux component current command signal of the motor 9, and a magnetic flux estimator 19E estimates a magnetic flux from a magnetic flux component current outputted from the current converter 19B.

A subtractor 19F substracts an output magnetic flux of the magnetic flux estimator 19E from the magnetic flux command outputted from the magnetic flux command generator 19D and outputs a magnetic flux difference signal to a magnetic flux controller 19G.

The magnetic flux controller 1 9G outputs a magnetic flux component current corresponding to the magnetic flux difference signal outputted from the subtractor, and a subtractor 19H computes a compensating value of the magnetic flux component current outputted from the magnetic flux controller 19G to output it, and the magnetic flux current controller 191 outputs a magnetic flux voltage command in proportion to the difference.

Meanwhile, the subtractor 19J subtracts the rotation speed of the motor obtained by the speed detector 19C from a command speed represented by the speed command signal b1 inputted from the operation control unit 18, to output a speed difference signal.

Accordingly, the speed controller 19K outputs a torque current corresponding to the speed difference signal, and an adder 19L adds a load compensation current b2 inputted from the operation control unit 18 to the torque current, and outputs a corresponding torque current command.

A subtractor 19M subtracts an output torque current of the current converter 19B from the torque current outputted from the adder 19L and outputs an difference signal of torque component current, and a torque current controller 19N outputs a torque voltage command signal in proportion to the difference of torque component current A slip frequency operator 190 computes a slip frequency according to a torque and a magnetic flux, and an adder 19P adds the computed slip frequency to the detecting speed of the speed detector 19C, and accordingly outputs a frequency command.

Then, a voltage converter 19Q receives a voltage command respectively outputted from the magnetic flux current controller 191 and the torque current controller 19N and the frequency command from the adder 19P, and generates a three-phase voltage command to output it to the pulse width modulation signal generator 20.

At this time, a power consumption P of the alternate current motor 9 and the torque Tq is expressed by the following equations (1), (2):

$$Tq=k\times Iq \tag{1}$$

$$P=Tq\times Wr \tag{2}$$

Wherein, k indicates a torque constant $$(k = \frac{3}{2}\times\frac{d}{2}\times\frac{Lm}{Lr}\times\lambda r,$$

d: number of the magnetic pole, Lm: mutual inductance, Lr: leakage inductance, Xr: rotator magnetic flux), Iq indicates a torque current, and Wr indicates an angular velocity (rad/sec).

FIG. 4 shows a power consumption of the motor 9 when the elevator car is operated in a state that the balance weight 12 and the elevator car 13 are maintained to be balanced, in case that an abrasion between the hoist way and the sheave 11 is neglected.

When the sign of the rotation direction of the motor 9 and that of the torque current b2 are identical to each other, the power consumption has a positive (+) value in the equation (2), and in this case, since the motor 9 serves as a load, a power required therefor is to be supplied from the power supply unit 17, for which the power consumption should be smaller than the maximum capacity of the power supply unit 17.

Meanwhile, in case that the sign of the rotation direction of the motor 9 and that of the torque current b2 are not identical to each other, a power consumption has a negative (−) value, and in this case, the alternate current motor 9 serves as a power generator.

In this case, since the generated electric power is consumed as a heat through the discharging transistor 5 and the resistor 6, it is not necessary for the power supply unit 17 to supply a power to the motor 9.

As described above, when a power failure occurs, the moving direction of the elevator car 13 is determined by the operation control unit 18 in a manner that after the weight of the elevator car 13 is detected on the basis of the output signal of the load detector 16, the weight of the elevator car and that of the balance weight 12 are compared to each other, upon which in case that the weight of the car 13 is heavier than that of the balance weight 12, the operation direction of the car 13 is determined to be a downward direction, while in the opposite case, the moving direction of the car 13 is determined to be an upward direction, thereby operating the car 13 toward the nearest floor from the current position.

Accordingly, since the operation control unit 18 wholly depends on the output signal of the load detector 16 when determining the running direction of the car 13, if the load detecting by the load detector 16 is not accurate or is not in a good condition for a normal operation due to a malfunction, a problem arises in that the car 13 may be operated undesirably in the opposite direction to its proper direction.

FIG. 5 shows a case that the car 13 is operated by the DC power charged in the battery 17F of the power supply unit 17 when a power failure occurs.

When the weight of the balance weight is heavier than that of the elevator car 13 and thus the car 13 runs in the upward direction, a power consumption has a negative (−) value and the motor 9 is operated as a power generator. At this time, the generated energy is charged to the smoothing capacitor 4 through the inverter 7, so that the voltage across the smoothing capacitor 4 is increased.

When the voltage of the both ends of the smoothing capacitor 4 is increased to more than a pre-set reference level, the discharging transistor 5 is operated and the generated power is consumed as a heat through the discharging resistance 6, so that the generated power is not transferred to the power supply unit 17.

Accordingly, since the power supply unit 17 needs to supply the power only to the operation control unit 18 and the speed control unit 19, the discharging amount of the charging battery 17F is minimized.

Generally, the charging capacity of the charging battery 17F and the capacity of the power converting unit 17D are designed in a full consideration of the power consumption for accelerating and power loss due to an friction with a rail in a state that the balance weight 12 and the car 13 are balanced.

However, in case that the load detector 16 is malfunction and the operation control unit 18 misjudges the direction in which the elevator car should run (for example, in case of a misjudgement that the motor 9 is operated as a load), as shown in FIG. 6, the power consumption of the motor 9 becomes more than a rated value, and thus, an overcurrent flows to the power supply unit 17, resulting in that the circuit element is broken down or the discharge amount of the charging battery 17F is excessive, causing a problem that the elevator system would be stopped before the car 13 reaches the nearest floor.

Therefore, in case of a power failure, according to the apparatus for controlling the operation of the elevator of the conventional art, since the running direction of the car is determined only on the basis of the output signal of the load detector, if the load detector detects the load inaccurately, or a breakdown thereof occurs, the running direction of the car is not determined properly, and moreover, the elevator system is supposed to be stopped before the car reaches the nearest floor.

SUMMARY OF THE INVENTION

Therefore, an object of the present invention is to provide an apparatus for controlling an operation of an elevator in which when an elevator is operated in emergency due to a power failure, a power consumption of a motor is computed, and if the computed power consumption exceeds a capacity of a power, supply unit, the speed of the elevator car is limited.

To achieve these and other advantages and in accordance with the purposed of the present invention, as embodied and broadly described herein, there is provided an apparatus for controlling an operation of an elevator in an elevator system having a converter for converting a main power supply to a direct current upon receipt of it, an inverter for inverting the direct current to an alternate current according to a pulse width modulating signal, an alternate current motor driven at a speed corresponding to the output from the inverter, a rotary encoder for generating a pulse signal according to a rotation speed of the motor, and a speed detector for detecting a speed of the alternate current motor, including: a power supply unit for detecting whether the main power supply was supplied including a charger and outputting a predetermined control signal; an operation control unit for receiving the control signal from the direct current power supply unit and a demand control signal inputted by a user and outputting a speed control signal and a load compensation signal so as to control the elevator system; a power consumption detector for computing a power consumption of the alternate current motor; a speed limiter for limiting a speed of the motor upon receipt of the alternate current motor speed signal from the speed detector and the power consumption of the motor computed by the power consumption detector; and a speed control unit for controlling a rotation speed of the alternate current motor upon receipt of the load compensation signal and the control signal from the speed limiter.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 4 is a waveform showing a power consumption pattern of a motor in operating an elevator in accordance with the conventional art;

FIG. 5 is a waveform showing a pattern of a power generated by a motor when an elevator car is upwardly operated without a load in accordance with the conventional art;

DETAILED DESCRIPTION OF THE PREFERRED EMBODIMENTS

Reference will now be made in detail to the preferred embodiments of the present invention, examples of which are illustrated in the accompanying drawings.

Figure 7:
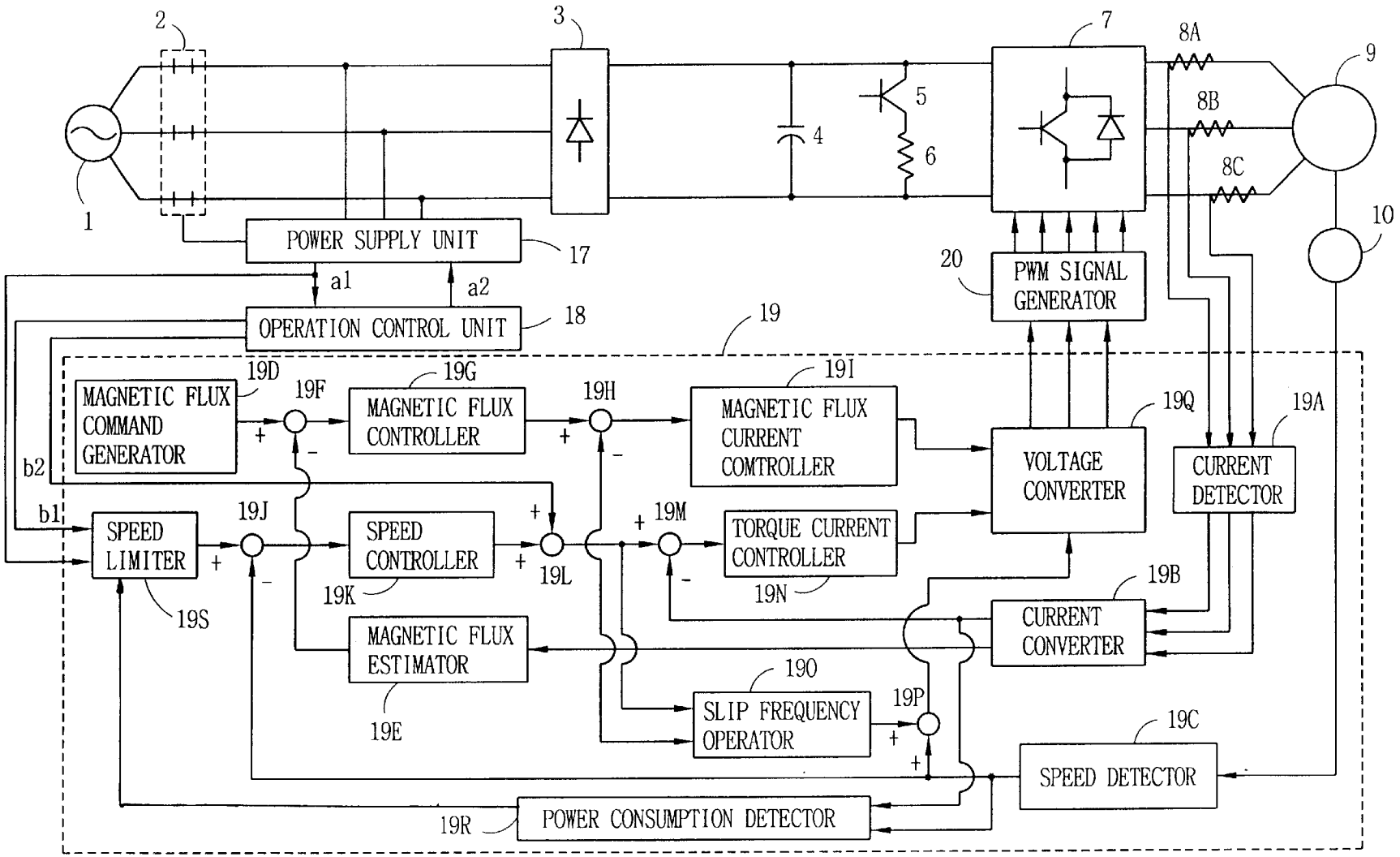
FIG. 7 is a schematic block diagram of an apparatus for controlling an operation of an elevator in accordance with the present invention.

FIG. 7 is a schematic block diagram of an apparatus for controlling an operation of an elevator in accordance with the present invention.

As shown in the drawing, the apparatus for controlling an operation of an elevator in accordance with the present invention includes a main power supply inputting contactor 2 for receiving a main power source in ordinary times and for blocking an input path of the main power source 1, a rectifier 3 and a smoothing condenser 4 for switching an inputted main power supply of alternate current to a direct current and smoothing it, a discharging transistor 5 and a resistance 6 for restraining a charged voltage of the condensor 4 from rising to more than a predetermined level, an inverter 7 for converting a direct current voltage outputted from the smoothing condenser 4 according to an output signal from a pulse width modulation signal generator 20 (which will be described later) to an alternate current power supply, current detecting elements 8A, 8B and 8C for detecting a current supplied from the inverter 7 to an alternate current motor 9, the alternate current motor 9 driven at a speed corresponding to an output power supply of the inverter 7, a rotary encoder 10 for generating a pulse according to a rotation speed of the alternate current motor 9, a power supply unit 17 for detecting whether the main power is supplied to the elevator system, an operation control unit 18 for controlling an operation of an elevator car according to a call signal of the elevator car, a speed control unit 19 for computing a power consumption of the alternate current motor 9 when the elevator car is operated in emergency on a power of a charging battery in accordance with a speed command received from the operation control unit 18, and outputting a speed control signal to limit the operation speed of the elevator in case that the computed power consumption exceeds a capacity of the power supply unit, and a pulse width modulation signal generator 20 for outputting a pulse width modulating signal to the inverter 7 upon receipt of a speed control signal from the speed control unit 19.

The speed control unit 19 includes a current detector 19A for outputting a current detect signal corresponding to a current amount of each phase detected through, current detecting elements 8A~8C connected between an output terminal of the inverter 7 and an input terminal of the alternate current motor 9, a current converter 19B for converting a current component detected by the current detector 19A to a current of torque component and a current of magnetic flux component, a speed detector 19C for detecting a rotation speed of the alternate current motor 9 on the basis of the pulse outputted from the rotary encoder 10 and outputting a corresponding speed detect signal, a power consumption detector 19R for computing a power consumption required for driving the alternate current motor 9 upon receipt of the speed detect signal from the speed detector 19C and the torque current from the current converter 19B, a speed limiter 19S for limiting a speed command received from the operation control unit 18 so as to reset it within an allowable capacity, in case that it is judged that the power consumption of the alternate current motor 9 detected by the power consumption detector 19R exceeds an allowable capacity of the power supply unit 17 when a power failure detect signal is inputted and the alternate current motor 9 is operated as a motor, and outputting a speed command as it is, in other cases, a magnetic flux command generator 19D for generating a magnetic flux command of the alternate current motor 9; a magnetic flux estimator 19E for estimating a magnetic flux from the magnetic flux component outputted from the current converter 19B, a subtractor 19F for subtracting an output magnetic flux of the magnetic flux estimator 19E from the magnetic flux command outputted from the magnetic flux command generator 19D and obtaining a magnetic flux error, a magnetic flux controller 19G for outputting a magnetic flux current in consideration of the magnetic flux error outputted from the subtractor 19F, a subtractor 19H for operating an error value of the magnetic flux component current outputted from the magnetic flux controller 19G, a magnetic flux current controller 191 for outputting a magnetic flux voltage command in proportion to the error of the magnetic flux component current obtained by the subtractor 19H, a subtractor 19J for subtracting an actual speed obtained by the speed detector 19C from the speed command outputted from the speed limiter 19S and obtaining a speed error, a speed controller 19K for outputting a torque current in consideration of the speed error obtained by the subtractor 19J; an adder 19L for adding a load compensation current inputted from the operation control unit to the torque current outputted from the speed controller 19K and outputting a corresponding torque current command, a subtractor 19M for subtracting an output torque current of the current converter 19B from the torque current outputted from the adder 19L and outputting an error of torque component, a torque current controller 19N for outputting a torque voltage command in proportion to the error of the torque component outputted from the subtractor 19M, a slip frequency operator 190 for operating a slip frequency according to the torque and the magnetic flux, an adder 19P for adding the slip frequency operated by the slip frequency operator 190 to the detecting speed of the speed detector 19C and outputting a frequency command corresponding to it, and a voltage converter 19Q for supplying a three-phase voltage command to the pulse width modulation signal generator 20 upon receipt of the voltage command each from the magnetic flux current controller 191 and the torque current controller 19N and the frequency command from the adder 19P.

The operation of the apparatus for controlling an operation of the elevator constructed as described above will now be explained with reference to FIGS. 1, 2, 8 and 9.

When an elevator car is operated on the power of the battery 17F of the power supply unit 17 in emergency as a power failure occurs, the power supply unit 17 outputs a power failure detect signal a1 to the operation control unit 18.

Then, the operation control unit 19 detects a weight of the elevator car 13 on the basis of the output signal of the load detector 16 and compares the weight of the elevator car 13 with that of the balance weight 12. Upon its comparison, the operation control unit 18 judges the operation direction of the elevator car and outputs a speed command b1 to the speed control unit 19.

The speed control unit 19 drives the speed controller 19K, the magnetic flux current controller 191 and the torque current controller 19N according to the speed command b1 so as to control the alternate current motor 9.

At this time, the power consumption detector 19R computes a power consumption required for driving the alternate current motor 9 upon receipt of the speed detect signal from the speed detector 19C and the torque current from the current converter 19B, for which the equations (1) and (2) obtained in the conventional art are also used.

The power consumption amount computed by the power consumption detector 19R is supplied to the speed limiter 19S. At this time, when the speed limiter 19S judges that there is a possibility that the operation control unit 18 mistakenly discriminates the operation direction of the elevator car so that the alternate current motor 9 is operated as a motor, according to which the power consumption exceeds the maximum available capacity of the power supply unit, the speed limiter 19S limits the speed command b1 received from the operation control unit 18 and resets it not exceeding the maximum available capacity.

Accordingly, the speed controller 19K controls the rotation speed of the alternate current motor 9 according to the speed control command outputted from the speed limiter 19S, thereby preventing an overcurrent to the power supply unit 17 or an early discharging of the power of the charging battery 17F.

Figure 1:
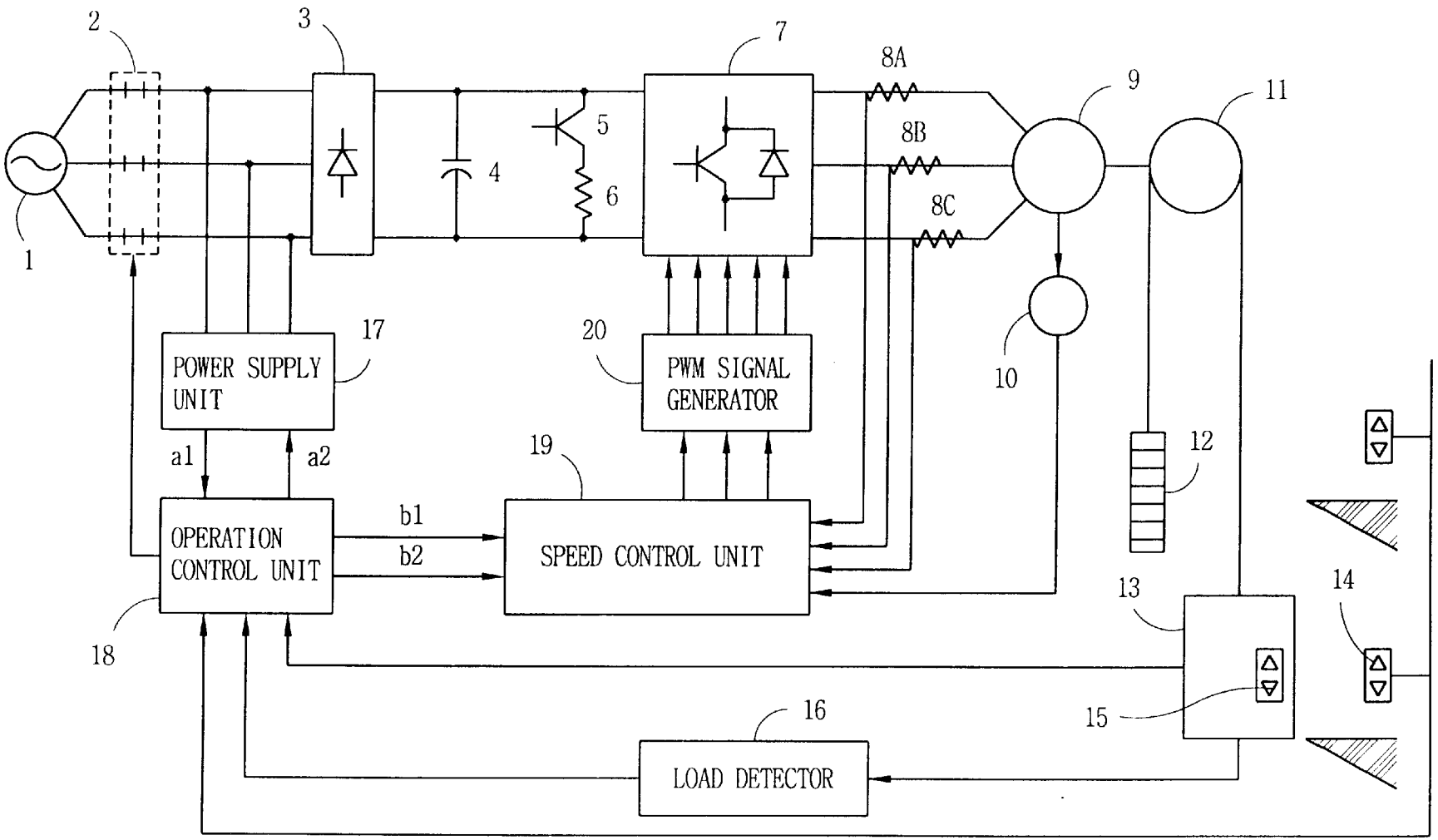
FIG. 1 CONVENTIONAL ART
FIG. 1 is a schematic block diagram of an apparatus for controlling an operation of an elevator in accordance with a conventional art.
Figure 2:
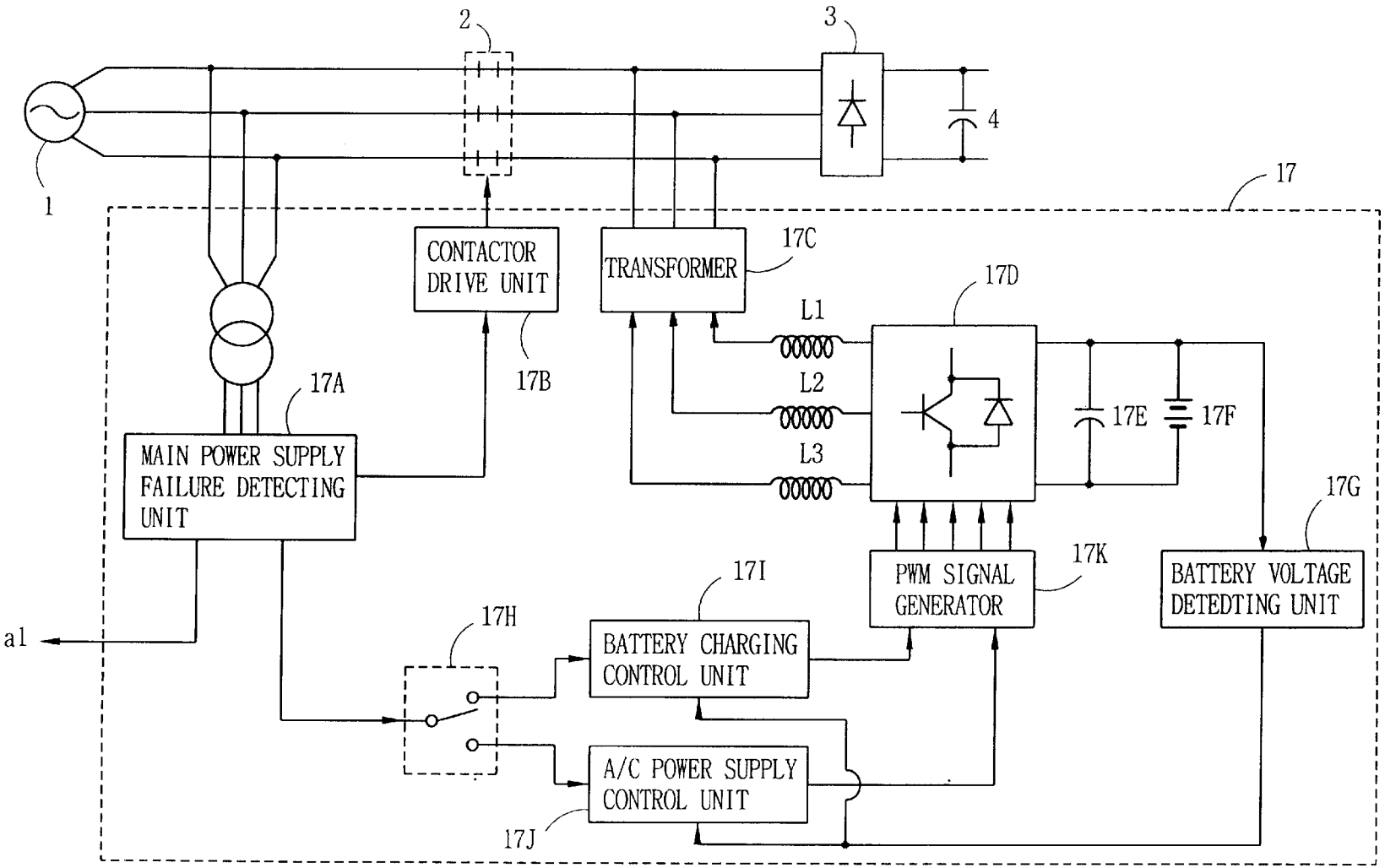
FIG. 2 CONVENTIONAL ART
FIG. 2 is a detailed block diagram of a power supply unit of FIG. 1 in accordance with the conventional art.
Figure 3:
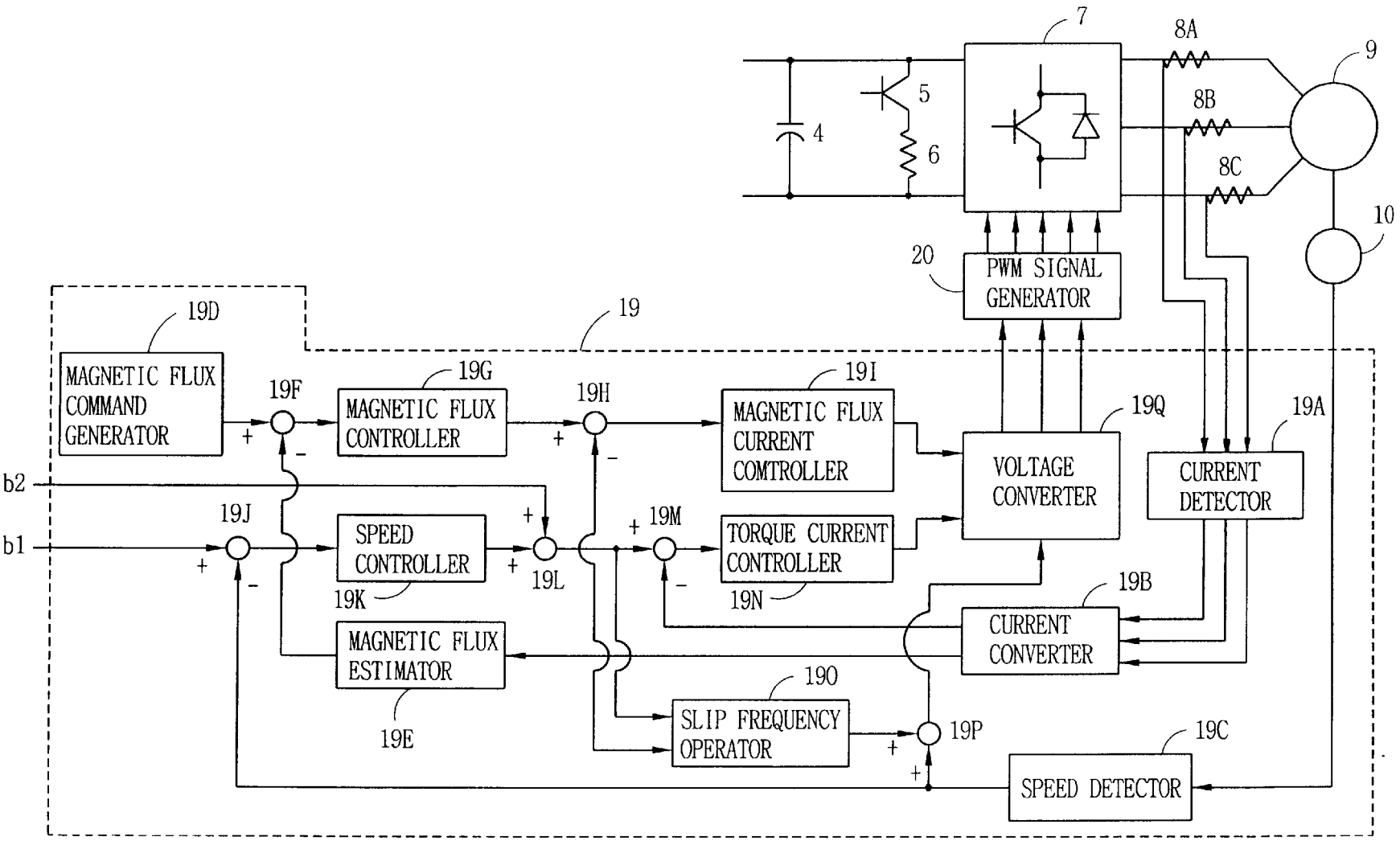
FIG.3 CONVENTIONAL ART
FIG. 3 is a detailed block diagram of a speed control unit of FIG. 1 in accordance with the conventional art.
Figures 6A, 6B, 6C:
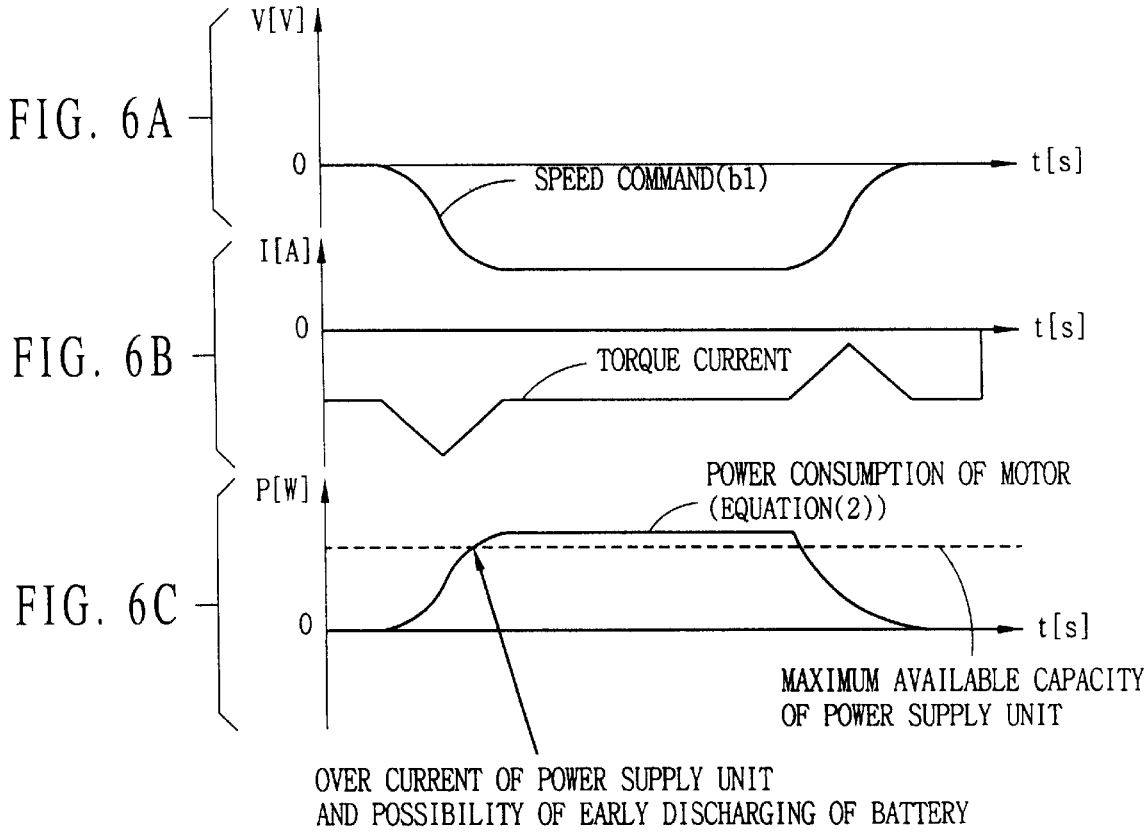
FIG. 6 is a waveform showing a pattern of a power generated by a motor when an elevator car is downwardly operated without a load in accordance with the conventional art.

Referring to FIG. 7, the process of the operation from the magnetic flux command generator 19D and the subtractor 19J to the pulse width modulation signal generator 20 is the same as the forgoing description with reference to FIG. 3.

Figure 9:
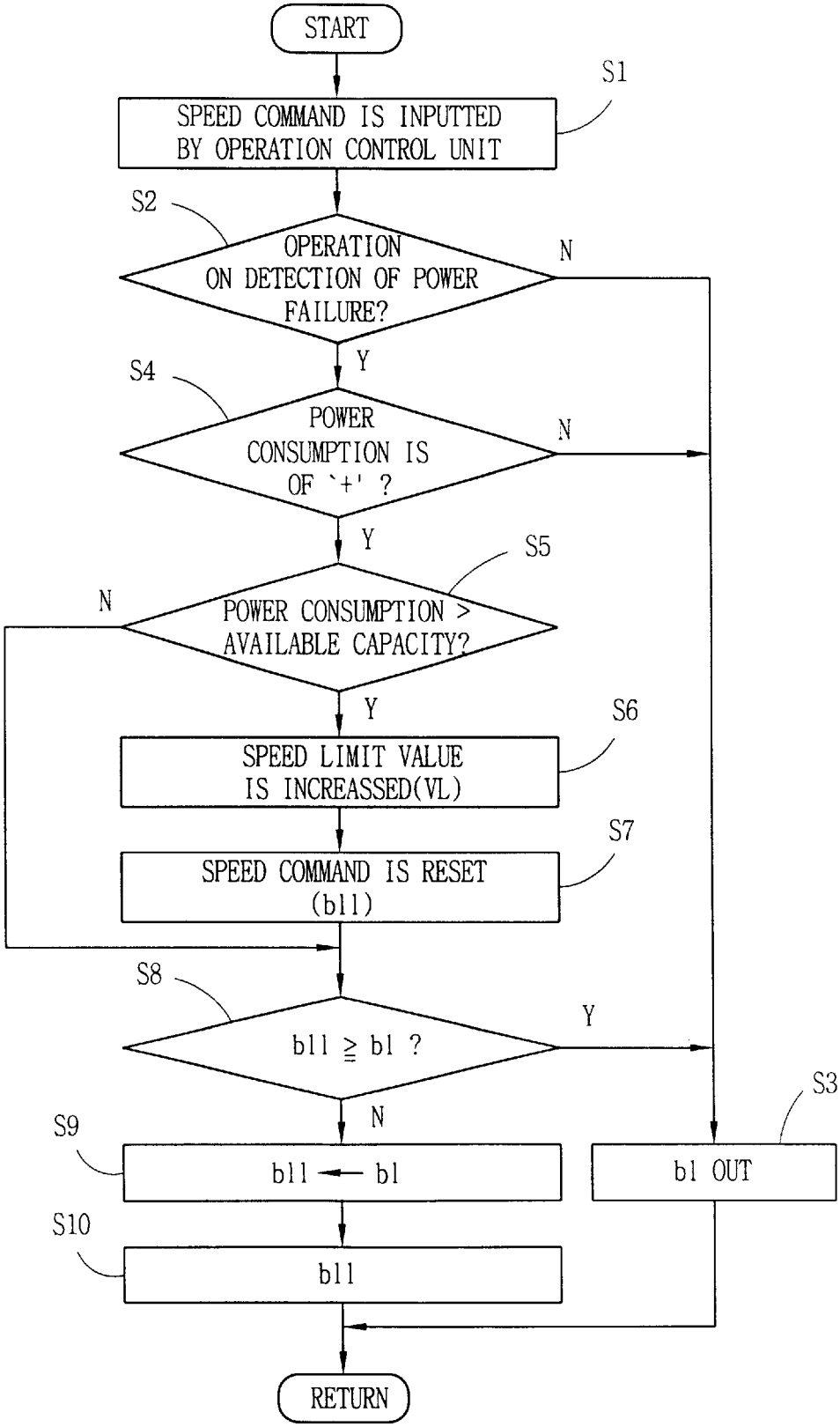
FIG. 9 is a flow chart of a method for controlling an operation of an elevator in accordance with the present invention.

The process for controlling the operation of the elevator in the power failure will now be described in detail with reference to FIG. 9.

The speed limiter 19S receives the speed command b1 from the operation control unit 18 and a power failure detect signal a1 from the power supply unit 17 in the step S1.

In case that no power failure detect signal a1 is inputted or a power consumption is of a negative (−) value even though the power failure detect signal was inputted, the speed command b1 outputted from the operation control unit 18 is transferred, as it is, to the subtractor 19J through the speed limiter 19S, according to which a normal speed control is performed in the steps S2~S4.

Meanwhile, in case that the power failure detect signal a1 is detected due to the power failure of the main power supply 1 and the power consumption is of positive (+) value, the power consumption detector 19R detects the power consumption of the alternate current motor 9. And, if it judges that the power consumption of the alternate current motor 9 reaches a level PL, that is, a possibility of exceeding the maximum available capacity Pmax of the power supply unit 17, the speed limiter 19S increases the speed limit value VL of the alternate current motor 9, while, if it judges that the power consumption is within the range of the maximum available capacity Pmax, the speed limiter 19S stops the operation for increasing the speed limit value PL of the alternate current motor 9 in the steps S5 and S6.

When the power consumption of the alternate current motor 9 is of a positive (+) value, the speed limiter 19S subtracts the speed limit value LV as computed from the speed command b1 of the operation control unit 18 and resets it by limiting the speed of the alternate current motor 9 in a step S7.

The limited speed command b11 as reset by the speed limiter 19S is smaller than the speed command b1 of the operation control unit 18, the speed command b1 is outputted to the subtractor 19J of the speed control unit 19 in steps S8 and S3.

Meanwhile, in case that the limited speed command b11 is greater than the speed command b1 of the operation control unit 18, the limited speed command b11 is outputted to the subtractor 19J in the steps S9 and S10.

Figures 8B, 8C:
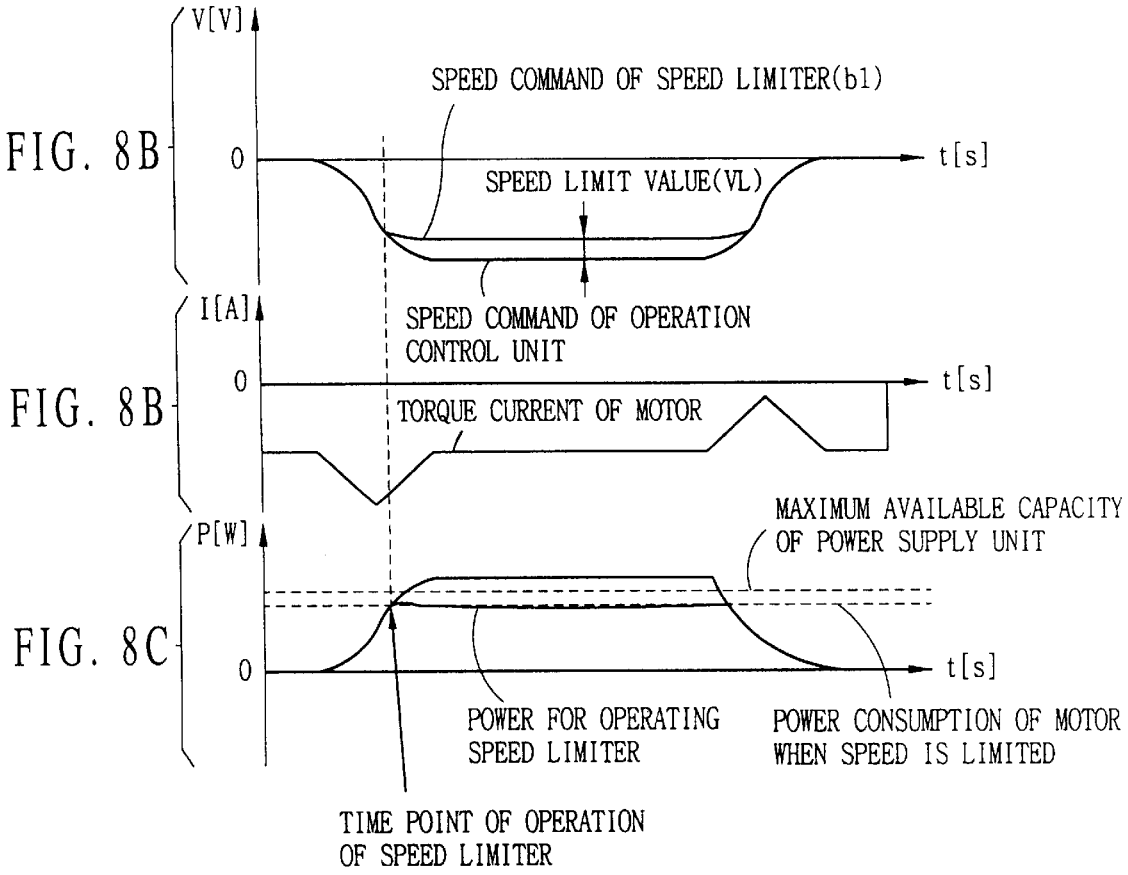
FIG. 8 shows an operation of a speed limiter and a waveform of a pattern of a power consumption in accordance with the present invention.

Accordingly, by supplying the speed command in the above-described manner, the power consumption of the alternate current motor 9 does not exceed the allowable capacity of the power supply unit 17 as shown in FIG. 8, thereby preventing a breakdown of the power supply unit, or an early discharging of the power of the charging battery 17F in advance.

As another embodiment of the present invention, the speed limiter 19S is included in the operation control unit 18, and as the power consumption detected by the power consumption detector 19R of the speed control unit 19 is received, when the power consumption exceeds the allowable capacity PL of the power supply unit, the speed command b1 is subtracted.

AS still another embodiment of the present invention, the power consumption detector 19R is induded in the power supply unit 17, and when the operation control unit 18 generates a speed command b1 of the alternate current motor 9, it is limited to be outputted according to the power consumption detected in the power supply unit 17.

As so far described, according to the apparatus and method for controlling the operation of the elevator in the power failure of the present invention, in case that a power failure occurs in the elevator system and the elevator car is operated on a charged battery power in emergency, the power consumption of the alternate current motor is computed, and if the computed power consumption exceeds the capacity of the power supply unit, the operation speed of the car is limited, so that a possible breakdown of elements due to an overcurrent flowing to the power supply unit can be prevented, and the elevator car is prevented from stopping due to an earlier discharging of the battery before it reaches the nearest floor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An apparatus for controlling the operation of an elevator when a power failure occurs in an elevator system which includes a main alternating current power source for supplying AC power to the system, a converter for converting the AC power from the power source to direct current, a first inverter for inverting the direct current to alternating current according to a pulse width modulated signal, a first pulse width modulator for providing a pulse width modulated signal to control a switching of the inverter, an alternating current motor driven at a speed corresponding to the alternating current output from the inverter, a pulse generator for generating a pulse signal according to a rotational speed of the motor, and a speed detector for detecting a speed of the motor depending on the pulse signal from the pulse generator, the apparatus comprising:

a direct current power supply unit including a power failure detector for detecting a power failure of the main power source, a battery for charging a voltage from the power source in normal state or supplying charged voltage when a power failure is detected depending on the output from the power failure detector, a second inverter for inverting a direct current from the battery into an alternating current, a second pulse width modulator for providing a pulse width modulated signal to control switching of the second inverter and a transformer for boosting output voltage from the second inverter;

an operation control unit for receiving a power failure detecting signal from the power failure detector and receiving a call signal or destination selection signal from a hall call or a car call of the elevator system and outputting a speed control signal and a load compensation signal so as to control the elevator system;

a power consumption detector for computing a power consumption of the motor;

a speed limiter for limiting a speed of the motor depending on the motor speed signal from the speed detector and the power consumption of the motor computer by the power consumption detector; and a speed control unit for controlling a rotational speed of the motor upon receipt of the load compensation signal and the control signal from the speed limiter.

2. The apparatus according to claim 1, wherein the power consumption detector computes the power consumption of the motor depending on the detected speed of the motor and a torque current of the motor.

3. The apparatus according to claim 1, wherein the power consumption detector detects that the motor is consuming the power if the computed power consumption of the alternating current motor is of a positive (+) value, and detects that the motor is generating a power if the computed power consumption of the motor is of a negative (–) value.

4. The apparatus according to claim 1, wherein the speed limiter subtracts a speed command from the motor speed signal so that the power consumption of the alternating current motor does not exceed the maximum capacity of the power supply unit.

5. A method of controlling the operation of an elevator when a power failure occurs in an elevator system which includes a main alternating current power source for supplying AC current to the system, a converter for converting the AC current from the power source to direct current, a first inverter for inverting the direct current into an alternating current according to a pulse width modulated signal; a first pulse width modulator for providing a pulse width modulated signal to control switching of the inverter, an alternating current motor driven at a speed corresponding to the alternating current output from the inverter, a pulse alternate generator for generating a pulse signal according to a rotational speed of the motor, and a speed detector for detecting a speed of the motor depending on the pulse signal from the pulse generator, the method comprising the steps of:

detecting a power failure of the main power source with a power failure detector, charging a voltage from the power source in a normal state or supplying charged voltage when a power failure is detected with a battery depending on the output from the power failure detector, inverting a direct current from the battery into an alternating current with a second inverter, providing a pulse width modulated signal with a second pulse width modulator to control switching of the second inverter and boosting output voltage from the second inverter with a transformer;

receiving a power failure detecting signal from the power failure detector and receiving a call signal or destination selection signal from a hall call or a car call of the elevator system and outputting a speed control signal and a load compensation signal so as to control the elevator system with an operation control unit;

computing a power consumption of the motor with a power consumption detector;

limiting a speed of the motor depending on the motor speed signal from the speed detector and the power consumption of the motor computed by the power consumption detector with a speed limiter; and controlling a rotational speed of the motor upon receipt of the load compensation signal and the control signal from the speed limiter with a speed control unit.

6. The method according to claim 5, further comprising the step of computing the power consumption of the motor depending on the detected speed of the motor and a torque current of the motor with the power consumption detector.

7. The method according to claim 5, further comprising the step of detecting that the motor is consuming power if the computed power consumption of the alternating current motor is of a positive (+) value, and detecting that the motor is generating power if the computed power consumption of the motor is of a negative (–) value with the power consumption detector.

8. The method according to claim 5, further comprising the step of subtracting a speed command from the motor speed signal so that the power consumption of the alternating current motor does not exceed a maximum capacity of the power supply unit with the speed limiter.

* * * * *